US006311624B1

(12) United States Patent
Theurer et al.

(10) Patent No.: US 6,311,624 B1
(45) Date of Patent: Nov. 6, 2001

(54) TRACK TAMPING METHOD AND MACHINE

(75) Inventors: Josef Theurer, Vienna; Bernhard Lichtberger, Leonding, both of (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 0 days.

(21) Appl. No.: 09/426,917

(22) Filed: Oct. 26, 1999

(30) Foreign Application Priority Data

Nov. 11, 1998 (AT) ..... 1883/98

(51) Int. Cl.[7] ..... E01B 29/00

(52) U.S. Cl. ..... 104/2; 33/287

(58) Field of Search ..... 33/1 Q, 286, 287, 33/288; 701/19; 104/2, 7.2

(56) References Cited

U.S. PATENT DOCUMENTS

| | | | | |
|---|---|---|---|---|
| 3,750,299 | * | 8/1973 | Plasser et al. | 33/287 |
| 4,658,730 | * | 4/1987 | Bechmann et al. | 33/287 |
| 5,012,413 | * | 4/1991 | Sroka et al. | 701/19 |
| 5,090,329 | * | 2/1992 | Theurer | 33/287 |
| 5,613,442 | * | 3/1997 | Ahola et al. | 33/287 |

* cited by examiner

*Primary Examiner*—Mark T. Le
(74) *Attorney, Agent, or Firm*—Collard & Roe, P.C.

(57) ABSTRACT

In a method of tamping a track, the displacements between the two reference points relative to each other are recorded during a first advance of the track tamper along the track to form a first curve indicating an existing track position. On the basis of the first curve, correction values are formed and a second curve indicating a desired track position is computed on the basis of the correction values. The track is then repositioned to the desired track position during a second advance of the track tamper along the track in response to the correction values while the track is tamped.

2 Claims, 3 Drawing Sheets

TRACK TAMPING METHOD AND MACHINE

BACKGROUND OF THE INVENTION

1. Field of the Invention

The present invention relates to a method of tamping a track with a track tamper running along the track on two undercarriages in an operating direction, which comprises the steps of generating an optical reference line determined by two reference points, each reference point being formed by a sensing element running along the track on a flanged roller, a first one of the sensing elements being positioned ahead of the track tamper in the operating direction and a second one of the sensing elements being positioned between the undercarriages, and measuring the position of the track in relation to the optical reference line. It also relates to a track tamper useful for carrying out this method.

2. Description of the Prior Art

U.S. Pat. No. 3,545,384 discloses a track tamper comprising a machine frame running on two undercarriages along the track in an operating direction. A tamping unit for tamping the track and a track position correcting unit are mounted on the machine frame. To correct the track position, a track position measuring system with a light beam reference line is used. The reference line is defined by a first reference point preceding the track tamper in the operating direction and a second reference point positioned at the track position correcting unit. The reference line is brought into a position extending parallel to the desired track position. A receiver having two light-sensitive cells forms the second reference point, the light-sensitive cells being spaced from each other in a vertical direction by a predetermined distance. Thus, the reference beam causes two different pulses which are used to control the tamping unit and the track position correcting unit.

It is known from Austrian patent No. 314,580 to control track lining tools by a laser beam emitter. In this machine, a laser beam is directed onto a fixed reference point laterally adjacent the track. This enables the track to be lined by moving it laterally until the reference beam registers with a mark on the fixed reference point.

According to European patent No. 401,260, a reference line ahead of a measuring bogie is defined by a reference point determined by known coordinates and a reference point positioned in the center of a receiver formed by a multiplicity of photo cells. In connection with a distance measuring instrument, the deviation of the second reference point from a desired position can be determined.

Finally, Austrian patent No. 328,490 discloses yet another type of track position correcting machine with a reference system preceding and comprising a reference line determined by two reference points.

SUMMARY THE INVENTION

It is the primary object of this invention to optimize a method and machine of the first-described type so that short track sections in particular may be readily brought into a desired position.

The above and other objects are accomplished according to the invention with a method of tamping a track with a track tamper running along the track on two undercarriages in an operating direction, which comprises generating an optical reference line determined by two reference points, each reference point being formed by a sensing element running along the track on a flanged roller, a first one of the sensing elements being positioned ahead of the track tamper in the operating direction and a second one of the sensing elements being positioned between the undercarriages. The position of the track in relation to the optical reference line is measured by recording displacements between the two reference points relative to each other during a first advance of the track tamper along the track to form a first curve indicating an existing track position, computing a second curve indicating a desired track position on the basis of correction values derived from the first curve, and repositioning the track to the desired track position, during a second advance of the track tamper along the track in response to the correction values, and tamping the track.

This method is carried out in accordance with another aspect of the present invention with a track tamper comprising a machine frame running on two undercarriages along the track in an operating direction, a tamping unit mounted on the machine frame, a track position correcting unit mounted on the machine frame, a track position sensing element mounted on the machine frame and running on a flanged roller along the track, a generator of an optical reference line arranged ahead of the machine frame in the operating direction, and a digital camera fixedly connected to the track position sensing element and arranged to receive the optical reference line.

In this manner, the existing track position may be rapidly determined and the track repositioning may be done accurately with a minimum of retrofitting. The track displacements may be advantageously determined with great accuracy while the tamper advances by recording the relative displacement between the two reference points so that the track position after correction corresponds precisely to the computed desired values. It is a particular advantage of this direct control of the second reference point and the track position correcting unit that the track position correction in the track section to be corrected may be carried out without a time-consuming formation of a ramp leading to the adjacent track section which remains unchanged.

BRIEF DESCRIPTION OF THE DRAWING

The above and other objects, features and advantages of this invention will become more apparent from the following detailed description of a now preferred embodiment thereof, taken in conjunction with the accompanying drawing wherein.

DETAILED DESCRIPTION OF THE PREFERRED EMBODIMENT

Figure 1:
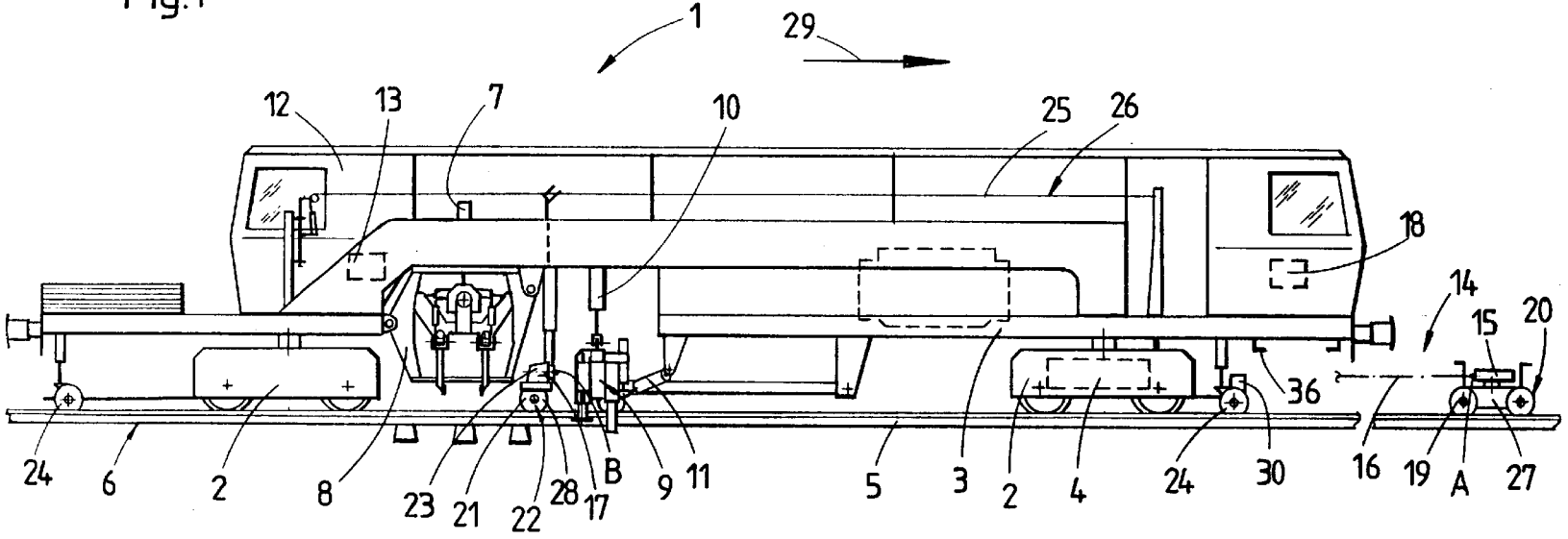
FIG. 1 is a side elevational view of a track tamper with a track position correction system according to the invention.
Figure 2:
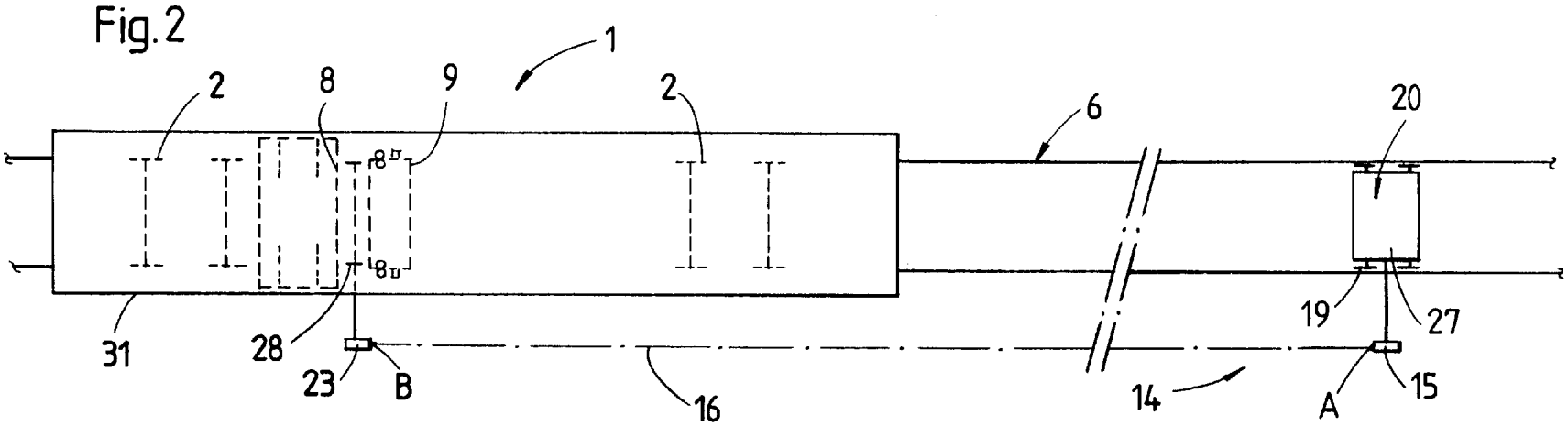
FIG. 2 is a schematic top view of the track tamper of FIG. 1, showing the emitter and receiver of the track position correction system.

Track tamper 1 illustrated in FIGS. 1 and 2 comprises machine frame 3 running on two undercarriages 2 along the track 6 in an operating direction indicated by arrow 29. The track is formed by rails 5 fastened to ties. To tamp ballast in the track bed under the ties, tamping unit 8 is mounted on the machine frame, and the tamping tools may be immersed in the track bed and raised out of it by drive 7 which lowers and lifts the tamping unit. Track position correcting unit 9, which comprises lifting and lining drives 10, 11, is also mounted on machine frame 3. Operator's cab 12 houses central control 13.

Track position errors are ascertained by track position measuring system 14 which comprises essentially a generator of an optical reference line 16, such as laser beam emitter 15, optical reference line receiver 17, such as digital camera 23, and control and computer unit 18. The reference line is determined by reference point A formed by the exit point of the laser beam and second reference point B formed by the point at which the laser beam impinges on digital camera 23. Rear track position sensing element 28 is mounted on machine frame 3 and runs on flanged roller 21 having measuring axle 22 along track 6, and receiver 17 is fixedly connected to the track position sensing element and is arranged to receive optical reference line 16 from laser beam emitter 15. The laser beam emitter is positioned on bogie 20 which runs on flanged rollers 19 along track 6 independently, and ahead, of track tamper 1 to form front track positioning element 27.

Track position sensing element 28 also is part of another reference system 26 comprising further track position sensing element 24 and steel wire 25. Track position sensing element 24 precedes track position sensing element 22 in the operating direction indicated by arrow 29 and is connected with odometer 30.

As can be seen in FIG. 2, reference line 16 defined by reference points A and B is positioned laterally adjacent track 6 and machine frame 3. For this purpose, digital camera 23 of rear track position sensing element 28 projects laterally from side 31 of machine frame 3.

Figure 3:
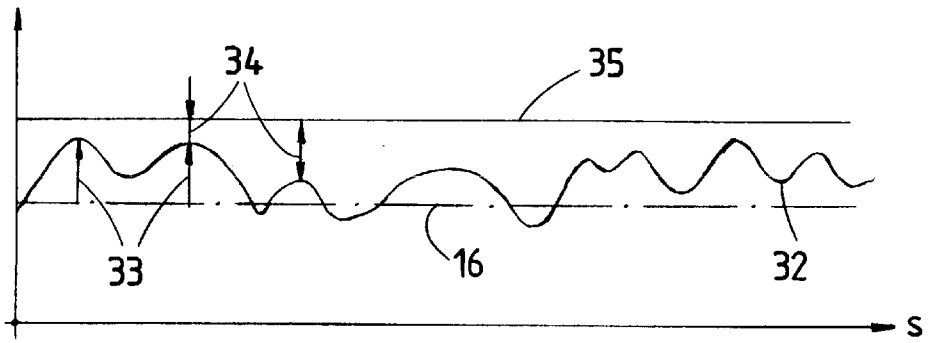
FIG. 3 shows a curve indicating the existing track position measured by the track position correction system.
Figure 4:
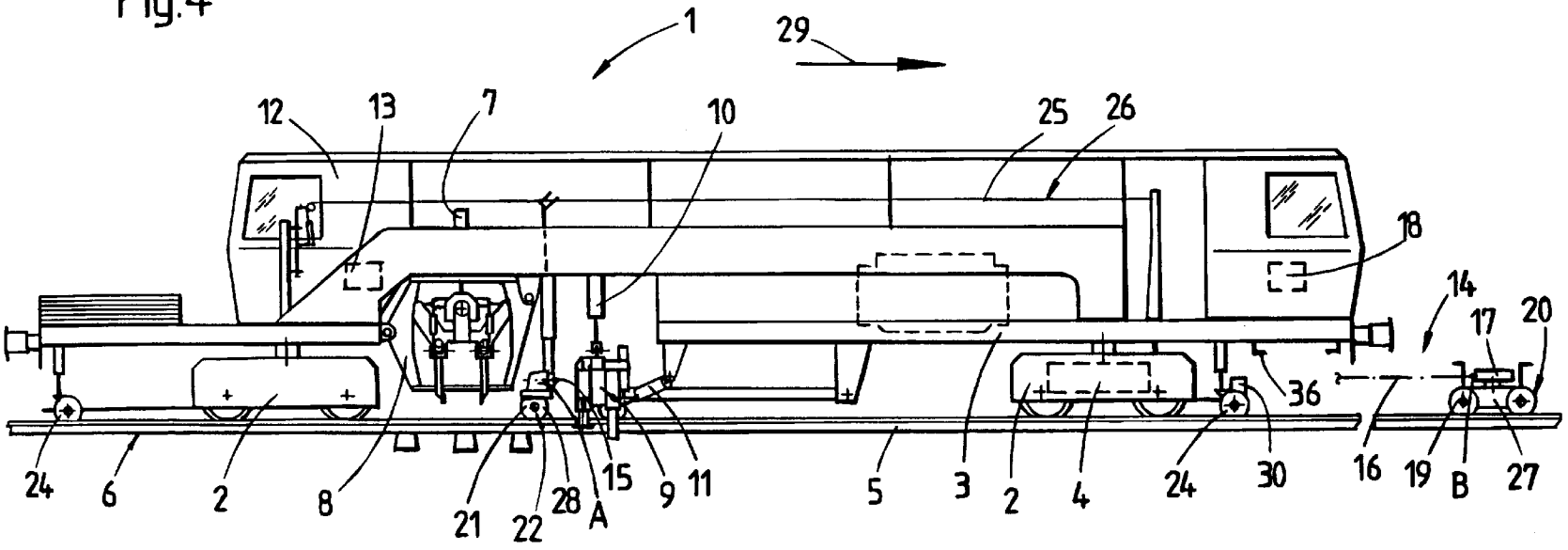
FIG. 4 is a side elevational view of a track tamper with an alternative arrangement of a track position correction system according to the invention.

FIG. 3 shows a curve 32 of an existing position of track 6 formed by a multiplicity of measured track points. The measurements consist of the recordings of the relative displacement 33 between reference point B in the range of track position correcting unit 9 and stationary reference point A ahead of tamper 1 in the operating direction. The relative displacement values are determined by the distance between stationary reference line 16 and each reference point on digital camera 23 running along track 6. Correction values 34 added to relative displacement values 33 produce desired position curve 35 of track 6. At the same time, odometer 30 measures the distance s of the advancement of track tamper 1.

The method of tamping track 6 with track tamper 1 running along the track on two undercarriages 2, 2 in an operating direction indicated by arrow 29 comprises generating optical reference line 16 determined by two reference points A and B. Each reference point is formed by a sensing element 27, 28 running along track 6 on flanged roller 19, 21. First sensing element 27 is positioned ahead of track tamper 1 in the operating direction and second sensing element 28 is positioned between undercarriages 2, 2. The position of track 6 in relation to optical reference line 16 is measured by recording displacements between the two reference points A and B relative to each other during a first advance of track tamper 1 along track 6 to form first curve 33 indicating an existing track position, computing correction values 34 and computing second curve 35 indicating a desired track position on the basis of the correction values. The track is repositioned to the desired track position during a second advance of track tamper 1 along track 6 in response to the correction values, and the track is tamped.

The position of optical reference line 16 is preferably maintained unchanged in relation to track tamper 1 during the first and second advances, and the displacements are recorded at second sensing element 28.

The method of the present invention and the operation of track tamper 1 will now be explained in detail:

After the track tamper is driven over the track section whose position is to be corrected, bogie 20 is detached from fixing mechanism 36 on track tamper 1 and is placed on track 6 in front of the track tamper, as shown in FIG. 1. The track tamper is then driven backwards, in a direction opposite to the operating direction indicated by arrow 29, until the track tamper has reached a position on a track section that needs no correction. At this point, track sensing element 28, which is arranged immediately adjacent tamping unit 8 and in front thereof, is lowered onto track 6 and is pressed against track rail 5 serving as a reference. Subsequently, laser beam emitter 15 is focused preferably on the center of receiver 17 and is fixed in position relative to bogie 20. Track tamper 1 is now advanced towards bogie 20, during which advancement track position irregularities will cause corresponding relative displacements between stationary reference line 16 and digital camera 23 whose position reflects these irregularities (see FIG. 3). Relative displacement values 33 are recorded and stored in control and computer unit 18, together with the measurement of the distance of advance of track tamper 1, recorded by odometer 30.

While the track tamper is then returned to its initial position at the beginning of the track section to be corrected, unit 18 will form desired track position curve 35 on the basis of existing track position curve 32 and compute position correction values 34. As the track tamper is advanced again in the operating direction and immediately before the track position operation begins, reference line 16 is automatically focused on that reference point on digital camera 23 which was recorded during the first advance and was used to form existing track position curve 32. The position of track 6 is corrected by track position correcting unit 9 to displace the track until reference line 16 is focused on that reference point in two-dimensional digital camera 23 which produces computed correction value 34 in relation to the existing track position.

Obviously, the same result in the method of this invention may be obtained if laser emitter 15 is connected to track sensing element 28 and receiver 17 is mounted on bogie 20, i.e. if the positions of reference points A and B are reversed, as shown in Figures. In that case, digital camera 23 would be stationary while reference line 16 would be moved relative to track 6 and machine frame 3 in response to irregularities in the track position.

What is claimed is:

1. A method of tamping a track with a track tamper running along the track on two undercarriages in an operating direction, which comprises the steps of (a) generating an optical reference line connecting two reference points, (1) each reference point being formed by a sensing element running along the track on a flanged roller, a first one of the sensing elements being positioned ahead of the track tamper in the operating direction and a second one of the sensing elements being positioned between the undercarriages, (b) advancing the track tamper from an initial point towards the first sensing element while the first sensing element remains stationary and recording displacements of the second sensing element relative to the reference line maintained stationary during the advance of the track tamper to form a first curve indicating an existing track position, (c) computing a curve indicating a desired track position on the basis of correction values derived from the first curve, (d) returning the track tamper to the initial point, and (e) again advancing the track tamper towards the first stationary sensing element, repositioning the track on the basis of the stationary reference line extending to the first stationary sensing element in response to the correction values, and tamping the repositioned track.

2. A method of tamping a track with a track tamper running along the track on two undercarriages in an operating direction, which comprises the steps of (a) generating an optical reference line connecting two reference points, (1) each reference point being formed by a sensing element running along the track on a flanged roller, a first one of the sensing elements being positioned ahead of the track tamper in the operating direction and a second one of the sensing elements being positioned between the undercarriages, (b) advancing the track tamper from an initial point towards the first sensing element while the first sensing element remains stationary and recording displacements of the first sensing element relative to the reference line maintained unchanged relative to the track tamper during the advance of the track tamper to form a first curve indicating an existing track position, (c) computing a curve indicating a desired track position on the basis of correction values derived from the first curve, (d) returning the track tamper to the initial point, and (e) again advancing the track tamper towards the first stationary sensing element, repositioning the track on the basis of the unchanged reference line extending to the second sensing element and of deviations of the unchanged reference line from the first sensing element in response to the correction values, and tamping the repositioned track.

* * * * *